US008813299B2

(12) United States Patent
Garbers et al.

(10) Patent No.: US 8,813,299 B2
(45) Date of Patent: Aug. 26, 2014

(54) TOOTHBRUSH WITH INCLINED BRISTLES AND POINTED BRISTLES

(75) Inventors: Christine Garbers, Basel (CH); André Brunella, Dornach (CH)

(73) Assignee: GABA International AG, Therwil (CH)

( * ) Notice: Subject to any disclaimer, the term of this patent is extended or adjusted under 35 U.S.C. 154(b) by 866 days.

(21) Appl. No.: 12/438,865

(22) PCT Filed: Aug. 17, 2007

(86) PCT No.: PCT/CH2007/000405

§ 371 (c)(1),
(2), (4) Date: Dec. 7, 2009

(87) PCT Pub. No.: WO2008/022480

PCT Pub. Date: Feb. 28, 2008

(65) Prior Publication Data

US 2010/0101038 A1 Apr. 29, 2010

(30) Foreign Application Priority Data

Aug. 25, 2006 (CH) ..... 1364/06

(51) Int. Cl.
*A46B 9/04* (2006.01)

(52) U.S. Cl.
USPC ..... 15/167.1

(58) Field of Classification Search
USPC ..... 15/167.1, 186–188, 191.1, DIG. 5; D4/104, 112, 130
IPC ..... A46B 9/04
See application file for complete search history.

(56) References Cited

U.S. PATENT DOCUMENTS

| | | | | |
|---|---|---|---|---|
| 3,085,273 | A * | 4/1963 | Cowan | 15/167.1 |
| 3,295,156 | A * | 1/1967 | Brant | 15/167.1 |
| 4,081,876 | A | 4/1978 | Pugh | |
| 5,446,940 | A * | 9/1995 | Curtis et al. | 15/167.1 |
| 5,533,227 | A * | 7/1996 | Ito et al. | 15/167.1 |
| 5,628,082 | A | 5/1997 | Moskovich | |
| 6,405,401 | B1 | 6/2002 | Hellerud et al. | |
| 6,546,586 | B2 * | 4/2003 | Cho | 15/167.1 |

(Continued)

FOREIGN PATENT DOCUMENTS

| | | |
|---|---|---|
| CA | 2618383 | 2/2007 |
| CN | 2469905 Y | 1/2002 |

(Continued)

OTHER PUBLICATIONS

International Preliminary Report on Patentability and Written Opinion from the International Bureau for International Application No. PCT/CH2007/000405 dated Mar. 17, 2009.

(Continued)

*Primary Examiner* — Rachel Steitz
*Assistant Examiner* — Jennifer Gill
(74) *Attorney, Agent, or Firm* — Ryan M. Flandro

(57) ABSTRACT

A brush head for a toothbrush with bunches of bristles inserted therein, wherein at least one of these bunches of bristles protrudes out of the bristle surface in a perpendicular fashion and at least one of these bunches is inclined, and is characterized in that the inclined bunches of bristles comprise cylindrical bristles, and in that at least some of the bunches which protrude in a perpendicular fashion comprise pointed bristles.

17 Claims, 2 Drawing Sheets

(56) References Cited

U.S. PATENT DOCUMENTS

| | | | | |
|---|---|---|---|---|
| 6,643,886 | B2 * | 11/2003 | Moskovich et al. | 15/167.1 |
| 2002/0162183 | A1 | 11/2002 | Cho | |
| 2003/0115708 | A1 * | 6/2003 | Edwards et al. | 15/207.2 |
| 2003/0163881 | A1 * | 9/2003 | Driesen et al. | 15/22.1 |
| 2004/0070258 | A1 | 4/2004 | Kwon | |
| 2005/0268414 | A1 * | 12/2005 | Kim | 15/167.1 |
| 2006/0090276 | A1 | 5/2006 | Sorrentino | |
| 2006/0096053 | A1 * | 5/2006 | Fischer et al. | 15/167.1 |
| 2007/0039113 | A1 * | 2/2007 | Kwon et al. | 15/167.1 |
| 2008/0201886 | A1 * | 8/2008 | Bielfeldt et al. | 15/167.2 |
| 2008/0271276 | A1 * | 11/2008 | Garberg et al. | 15/167.1 |
| 2010/0223746 | A1 * | 9/2010 | Mueller | 15/167.1 |

FOREIGN PATENT DOCUMENTS

| | | | |
|---|---|---|---|
| CN | 2572828 | Y | 9/2003 |
| CN | 2596838 | Y | 1/2004 |
| CN | 2708742 | Y | 7/2005 |
| EP | 0 405 204 | | 1/1991 |
| EP | 0405204 | | 1/1991 |
| EP | 0 449 653 | | 10/1991 |
| EP | 0 596 633 | | 12/1997 |
| EP | 0885573 | | 12/1998 |
| EP | 0 885 573 | | 5/2003 |
| EP | 1 425 989 | | 6/2004 |
| EP | 1 234 525 | B1 | 10/2004 |
| FR | 2331981 | A | 6/1977 |
| FR | 2624360 | A | 6/1989 |
| FR | 2624360 | A | 6/1989 |
| JP | 09-206131 | * | 8/1997 |
| KR | 0130932 | | 4/1998 |
| RU | 2020846 | | 10/1994 |
| WO | WO 99/23910 | | 5/1999 |
| WO | WO 00/25631 | | 5/2000 |
| WO | WO 03/073958 | | 9/2003 |

OTHER PUBLICATIONS

International Search Report from the European Patent Office as Searching Authority for International Application No. PCT/CH2007/000405 dated Dec. 3, 2007.

Decision on Grant from the Patent Office of the Russian Federation for corresponding Russian Patent Application No. 2009110775/12(014641) dated Mar. 23, 2010.

* cited by examiner

TOOTHBRUSH WITH INCLINED BRISTLES AND POINTED BRISTLES

CROSS-REFERENCE TO PRIOR APPLICATIONS

This application is a National Stage entry under 35 U.S.C. §371 of PCT Application No. PCT/CH2007/000405 filed on 17 Aug. 2007 which claims the benefit of Swiss Application No. CH 1364/06 filed on 25 Aug. 2006, the contents of which are incorporated herein by reference in their entirety for all purposes.

BACKGROUND

1. Field of the Invention

The present invention concerns brush heads for tooth brushes in which some of the tufts are slanted and some of the tufts are upright.

2. Background of the Invention

Tooth brushes with a mixed studding of tufts rising upright from the bristle carrier, on the one hand, and slanted x-wise crossing tufts, on the other hand, with all bristles being cylindrical, are known from EP-A-0 885 573. The applicant of the present application has been marketing in Europe three tooth brushes of this type, under the names Elmex Inter X, Elmex Inter X sensitive and Elmex Inter X junior. These tooth brushes are distinguished from a brush with exclusively vertically upright or exclusively x-wise crossing tufts by a good cleaning performance for both the tooth surfaces and the spaces between the teeth.

Recently, tooth brushes with so-called "pointed" bristles have also become known, say, from EP-A-0 596 633, wherein only pointed bristles are present in upright standing tufts. Pointed bristles are more flexible than traditional bristles and therefore allow for a more gentle cleaning of the tooth surfaces with less risk of injury.

The problem of the present invention was a further improvement of the brush heads for tooth brushes.

SUMMARY OF THE INVENTION

This problem is solved by a brush head for a tooth brush that has a handle part, a head part, and a bristle surface with tufts of bristles set therein, wherein at least one of these bristle tufts is vertical on the bristle surface and at least one of these tufts is slanted, characterized in that the slanted bristle tufts consist of cylindrical bristles and at least some of the upright tufts consist of pointed bristles.

Preferred embodiments will be found in the subclaims.

Surprisingly, it has been found that such brush heads enhance the mesial/distal cleaning performance on the tooth surfaces and at the same time a more gentle cleaning of the tooth surfaces is possible.

DETAILED DESCRIPTION OF THE INVENTION

Figure 1:
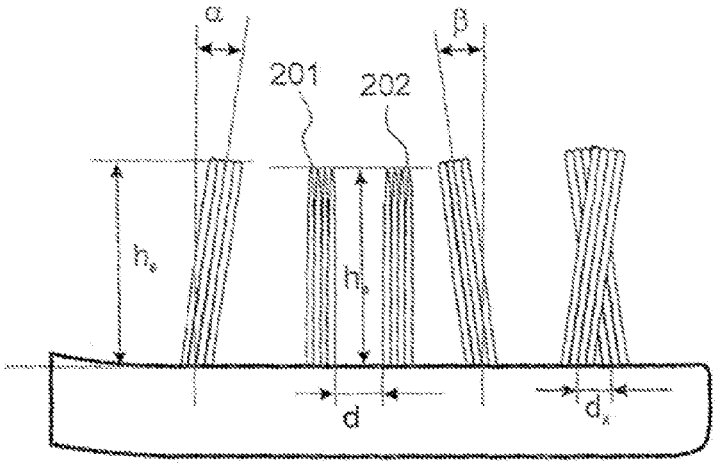
FIG. 1 shows how certain quantities used in the context of the present invention in regard to the slanted and pointed bristle tufts are to be understood.

The brush heads of the invention, besides having at least one vertically upright tuft of pointed bristles, also have one or more slanted tufts.

The term "slanted" means in the context of the present application that a slanted tuft is tilted at an acute angle to an imaginary line running vertical to the brush surface, and this imaginary line passes through the midpoint of the hole in the bristle carrier belonging to that tuft. This acute angle can be around 1 to around 45°, preferably around 1° to around 10°, more preferably around 7 to around 9° and most preferably around 8°. Thus, a slanted tuft can be slanted forward, backward, or to one side by the aforesaid acute angle. In particular, in one embodiment of the invention, it can be preferable for those tufts situated at the edge of the bristle carrier to be standing up from the bristle carrier by the aforesaid acute angle and slanting outward, which enables a better cleaning of the gums.

Preferably, however, "slanted" means that the tuft in question is slanting forward or backward, or preferably that all slanted tufts are slanting either forward or backward. The term "slanting backward" means in the context of the present application that a backward slanting tuft is tilted toward the handle part by the acute angle, looking in the lengthwise direction of the bristle carrier, and the term "slanting forward" means in the context of the present application that a forward slanting tuft is tilted away from the handle part by the acute angle, looking in the lengthwise direction of the bristle carrier.

The brush head of the invention has a surface which can be planar or arched, and that has holes designed to receive the tufts. The tufts of bristles in the finished brush head protrude from this surface. This surface is known as the "bristle surface".

The tufts projecting vertically from the bristle surface consist at least in part of pointed bristles. By "at least in part" in the context of the application is meant that preferably at least 50% and more preferably at least 80% of the bristle ends are pointed. Especially preferably, all bristles in the vertically upright tufts are pointed.

Preferably, the tufts of the invented brush head have a circular cross section; also preferably, they all have the same diameter of the circular cross sectional surface.

The term "pointed bristle" is the technical term for a bristle whose one end or whose both ends have been reduced in thickness by means of chemical etching (e.g., with sulfuric acid or with sodium hydroxide) or by means of mechanical sharpening so that the bristle is given a somewhat conical profile, tapering toward its end. If both ends of the bristle are so treated, one speaks of a "two-ended pointed bristle", otherwise a "one-ended pointed bristle". Details on the method of production of pointed bristles are described in various patent publications; for example, refer to EP-A-1 234 525, Korean patent No. 130932 and US-A-2004/0070258. For the present invention, suitable pointed bristles are also available on the market, say, from the manufacturers Sogo, Hylon, Best Whasung, Chcil Jedang, Lion and Wessen.

Preferably, the pointed ends of the bristles are tapering toward their pointed end, about a central axis of a solid of revolution with rotational symmetry to the bristle. In this case, the pointed bristles especially preferably have a profile (i.e., a diameter of the solid of revolution as a function of the distance from the pointed end) that corresponds roughly to the numerical values from one of the following tables 1 to 5. In these tables, the mean diameters of the bristles are shown as a function of the distance from the pointed end. The "diameter range" indicated in these tables is a typical standard deviation of the diameter determined from several bristle samples; this standard deviation can also be used as a feature characterizing the limits of the range of the diameter of these five profiles especially preferred according to the invention.

TABLE 1

| | Distance from pointed end (mm) | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter (mm) | 0.109 | 0.066 | 0.107 | 0.147 | 0.172 | 0.183 | 0.190 | 0.195 | 0.197 | 0.199 | 0.201 | 0.203 | 0.202 |
| Diameter range (+/− mm) | 0.005 | 0.006 | 0.012 | 0.019 | 0.021 | 0.020 | 0.019 | 0.014 | 0.014 | 0.014 | 0.012 | 0.011 | 0.010 |

TABLE 2

| | Distance from pointed end (mm) | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter (mm) | 0.017 | 0.086 | 0.140 | 0.172 | 0.185 | 0.192 | 0.198 | 0.201 | 0.204 | 0.205 | 0.205 | 0.208 | 0.209 |
| Diameter range (+/− mm) | 0.005 | 0.012 | 0.018 | 0.021 | 0.018 | 0.015 | 0.013 | 0.010 | 0.009 | 0.008 | 0.008 | 0.007 | 0.006 |

TABLE 3

| | Distance from pointed end (mm) | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter (mm) | 0.014 | 0.058 | 0.096 | 0.127 | 0.151 | 0.170 | 0.183 | 0.191 | 0.199 | 0.202 | 0.206 | 0.208 | 0.209 |
| Diameter range (+/− mm) | 0.001 | 0.003 | 0.009 | 0.009 | 0.009 | 0.008 | 0.007 | 0.006 | 0.008 | 0.005 | 0.006 | 0.005 | 0.003 |

TABLE 4

| | Distance from pointed end (mm) | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter (mm) | 0.0204 | 0.0691 | 0.112 | 0.137 | 0.150 | 0.156 | 0.159 | 0.162 | 0.163 | 0.164 | 0.165 | 0.165 | 0.166 |
| Diameter range (+/− mm) | 0.002 | 0.013 | 0.010 | 0.011 | 0.009 | 0.009 | 0.008 | 0.008 | 0.007 | 0.007 | 0.007 | 0.007 | 0.007 |

TABLE 5

| | Distance from pointed end (mm) | | | | | | | | | | | | |
|---|---|---|---|---|---|---|---|---|---|---|---|---|---|
| | 0 | 1 | 2 | 3 | 4 | 5 | 6 | 7 | 8 | 9 | 10 | 11 | 12 |
| Diameter (mm) | 0.015 | 0.050 | 0.084 | 0.113 | 0.132 | 0.148 | 0.158 | 0.166 | 0.173 | 0.176 | 0.180 | 0.183 | 0.184 |
| Diameter range (+/− mm) | 0.003 | 0.006 | 0.004 | 0.005 | 0.005 | 0.006 | 0.006 | 0.007 | 0.005 | 0.005 | 0.004 | 0.003 | 0.003 |

The nonpointed part of the pointed bristles, if these bristles have rotational symmetry, can have a diameter of around 0.12 to 0.25, preferably around 0.17 to 0.20 mm.

Preferably, the tufts of the brush head of the invention are arranged in transverse rows running across its lengthwise direction, while each transverse row has either only forward slanting tufts with cylindrical bristles, or only backward slanting tufts with cylindrical bristles, or only bristles projecting vertically from the bristle surface with pointed and/or cylindrical bristles, and at least one transverse row of forward or backward slanted tufts and at least one transverse row of tufts projecting vertically from the bristle surface is present.

The cylindrical bristles preferably have a diameter of around 0.12 to around 0.25, preferably around 0.17 to around 0.19 mm.

The brush heads according to the invention preferably contain a first and a second transverse row of vertically projecting tufts of pointed bristles, and these two rows are adjacent. The tufts of these two transverse rows are preferably arranged so that one tuft each of the first transverse row and one tuft of the second transverse row lie in pairs on an imaginary line, parallel to the lengthwise direction of the brush head, and these two tufts are spaced apart on this line at a distance d of around 0.65 to around 0.95 mm, preferably around 0.7 to around 0.9 mm and more preferably around 0.75 to around 0.85 mm. Preferably, the tufts of the first and second transverse row have a height $h_a$ of around 10.0 to around 13.0 mm, preferably around 11.3 to around 11.7 mm, and more preferably around 11.5 mm.

More preferably, the brush heads of the invention also contain one, or better two double rows of x-wise crossing tufts. One of these double rows is adjacent to the above-mentioned first transverse row and the second double row is adjacent to the above-mentioned second transverse row. Each of these double rows consists of one transverse row of forward slanting tufts and another transverse row of backward slanting tufts. The tufts of one of these transverse rows are staggered relative to the tufts of the other transverse row, so that one tuft of one of these transverse rows and one tuft of the other of these transverse rows cross in pairs x-wise. The distance $d_x$ between the two transverse rows forming a double row is preferably around 0.7 to around 1.3 mm, more preferably around 0.9 to around 1.1 mm and especially preferably around 1 mm.

The slanted tufts can have a height $h_s$ which is equal to or somewhat greater than the height $h_a$ of the tufts of the aforementioned first and second transverse row. The height $h_s$ is preferably around 10.5 to around 13.5 mm, preferably around 11.5 to around 12.5 mm; especially preferably it is around 11.5 mm or around 12.5 mm. The height of a slanted tuft is taken to be the midpoint of the brush surface of this tuft, measured perpendicular to the bristle surface, having preferably been made plane by trimming and standing perpendicular to the central axis of the tuft.

If one or two double rows of x-wise crossing tufts are present, the distance $d_a$ between a double row of x-wise crossing tufts and the adjacent first (or second) transverse row of vertically projecting tufts is preferably around 2.5 to around 3.5 mm, more preferably around 2.7 to around 3.3 mm and especially preferably around 3.0 mm.

If precisely two double rows of x-wise crossing tufts are present, these are preferably separated from each other at a distance $d_{xx}$ in the lengthwise direction of around 8.5 to around 9.5 mm, more preferably around 8.7 to around 9.3 mm and especially preferably around 8.9 mm.

The brush head of the invention can preferably have additional transverse rows of vertically projecting tufts of cylindrical and/or pointed bristles, preferably only pointed bristles, looking in the lengthwise direction toward the head part and looking in the lengthwise direction toward the handle part. If the brush head of the invention has two double rows of x-wise crossing tufts, it will preferably have one (or better two) such additional transverse row adjacent to the one double row lying, closer to the handle part, looking in the lengthwise direction toward the handle part; and it will likewise have preferably one (or better two) such additional transverse row adjacent to the second double row lying closer to the head part, looking in the lengthwise direction toward the head part.

If the brush head of the invention has an additional (seventh) transverse row of vertically projecting tufts adjacent to the double row formed of the third and fourth transverse row lying closer to the handle part, looking in the lengthwise direction toward the handle part, and an additional (eighth) transverse row of vertically projecting tufts adjacent to the double row formed of the fifth and sixth transverse row lying closer to the head part, looking in the lengthwise direction toward the head part, then the seventh and eighth transverse rows are preferably spaced at a distance $d_b$ of around 2.5 to around 3.5, more preferably around 2.7 to around 3.3 mm and especially preferably around 3.0 mm from the double row lying closer to the handle part or from the double row lying closer to the head part, respectively.

If the brush head of the invention has an additional (ninth) transverse row of vertically projecting tufts adjacent to the seventh transverse row looking in the lengthwise direction toward the handle part, and an additional (tenth) transverse row of vertically projecting tufts adjacent to the eighth transverse row looking in the lengthwise direction toward the head part, then the ninth transverse row is preferably spaced at a distance $d_c$ of around 5.0 to around 6.0 mm, more preferably around 5.2 to around 5.8 mm, and especially preferably around 5.5 mm from the double row lying closer to the handle part; and the tenth transverse row is preferably spaced at a distance of around 4.9 to around 5.9 mm, more preferably around 5.2 to around 5.6 mm, and especially preferably around 5.4 mm from the double row lying closer to the head part.

The heights $h_b$ and $h_{cd}$ of the tufts of the seventh, eighth, ninth and tenth transverse row are preferably around 10.0 to around 13.0 mm, more preferably around 11.0 to around 12.0 mm and especially preferably around 11.3 to around 11.7 mm. Especially preferably, the heights $h_b$ and $h_{cd}$ are equal to the height $h_a$ of the tufts of the first and second transverse row.

As for the heights $h_a$, $h_b$ and $h_{cd}$ of the vertically projecting tufts, it should be mentioned that these can be mean heights when these tufts contain pointed bristles or consist of them, because these are preferably not trimmed and therefore the individual bristles can have different heights.

In the context of the present application, distances between two transverse rows of tufts are generally measured as the distance between two imaginary lines, each one joining the midpoints of the cross sectional areas of the tufts of one transverse row and the midpoints of the cross sectional areas of the tufts of the other transverse row. In order to determine the distance d between the preferably present first and second transverse row of vertically projecting tufts of pointed bristles, from the distance of the transverse rows as determined above one further subtracts the diameter of the tufts present in these two transverse rows. The distance in the lengthwise direction of the brush head between one transverse row of vertically projecting tufts and one transverse row of x-wise crossing tufts is the mean value of a) the distance between the transverse row in question and the one transverse row forming the double row, and b) the distance between the transverse row in question and the second transverse row forming the double row. This pertains to the distances $d_b$, $d_c$, and $d_d$. The distance $d_{xx}$ between two double rows of x-wise crossing tufts is the mean value of a) the distance between the forward slanting transverse row of the first double row and the backward slanting transverse row of the to second double row, and b) the distance between the backward slanting transverse row of the first double row and the forward slanting transverse row of the second double row.

The pointed bristles can consist of any material that is usually employed for pointed tooth brush bristles. Preferably, the bristles are made from a polyester, especially a poly(C2-C8)alkylene terephthalate, wherein the (C2-C8)alkylene is preferably unbranched. More preferably, the bristle materials are polyethylene terephthalate, polypropylene terephthalate, polybutylene terephthalate and polypentylene terephthalate; polybutylene terephthalate is especially preferred.

The cylindrical bristles can consist of any material that is usually employed for tooth brush bristles. Preferably, the nonpointed bristles are made from a polyamide, which is made from a preferably unbranched (C2-C8)-1,.omega.-diamine and a preferably unbranched (C4-C14)-1,.omega.-dicarboxylic acid. More preferably, the bristle materials for the cylindrical bristles are polydimethylene adipamide, polytrimethylene adipamide, polytetramethylene adipamide, polypentamethylene adipamide, polyhexamethylene adipamide, polydimethylene dodecanamide, polytrimethylene dodecanamide, polytetramethylene dodecanamide, polypentamethylene dodecanamide, polyhexamethylene dodecanamide. Polyhexamethylene dodecanamide is especially preferred.

The brush head of the invention can be used for a manual tooth brush or for an electric tooth brush. The bristles arranged on the brush head will be set in motion either by manual movements, by motor operation, or by sonic waves.

The manufacture of the brush heads according to the invention can be done by analogy with the manufacture of already known brush heads.

To make the tufts, one can use one-ended or two-ended pointed bristles.

The holes of the bristle carrier serving to accommodate the tufts can be drilled into the bristle carrier in advance at any desired angle $\alpha$ or $\beta$, preferably they can also be made directly during the production of the bristle carrier through injection molding, making use of perforated dies. The holes are preferably of circular cross section in order to make possible the preferred circular cross section of the tufts.

If, for the vertically projecting tufts, one uses pointed and cylindrical bristles mixed in any desired ratio, the tuft is preferably anchored in a hole of the bristle carrier by means of an anchor plate or a loop. All bristles of the tuft being formed are grasped in U-shaped fashion inside the hole, so that both ends of each bristle protrude from the hole. As a rule, the holes here are not continuous. The proportion of pointed ends of the tuft is exactly equal to the proportion of double pointed bristles used.

When one-ended pointed and cylindrical bristles are mixed in a vertically projecting tuft or only one-ended pointed bristles are used, the tuft on the one hand can be anchored as before in the hole or it can be made by the familiar AFT ("anchor free tufting") method. In this method, the bristles are introduced into a carrier plate, which has continuous holes, and the bristles of each tuft are welded together by a hot stamp at the back-side hole opening. The bristles then protrude from the front-side hole opening of the carrier plate. The plate provided with the tufts can then be cast or welded in a brush head. Details of this method are described in, say, EP-A-0 405 204. The proportion of pointed ends in the tuft in the production variant with anchoring is equal to half the proportion of one-ended pointed bristles used; when using the AFT method, it is precisely equal to this proportion used.

The slanted tufts which contain only cylindrical bristles are preferably trimmed to a uniform height according to the invention. The vertically projecting tufts, which can contain pointed or cylindrical, or mixed pointed and cylindrical bristles, or only pointed bristles are preferably not trimmed according to the invention. When making prototypes, the selective trimming of tufts containing only nonpointed bristles can be done most easily with small, pointed scissors, such as microscope scissors. In mass production, the steps of implanting the slanted tufts with cylindrical bristles, the trimming and optional rounding of the bristles of these tufts, and finally the implanting of the vertically projecting tufts, consisting in part or entirely of pointed bristles, can be carried out in the indicated series in separate, consecutive work processes. The machinery and details of the process for each step are familiar to the person skilled in the art.

Figure 2:
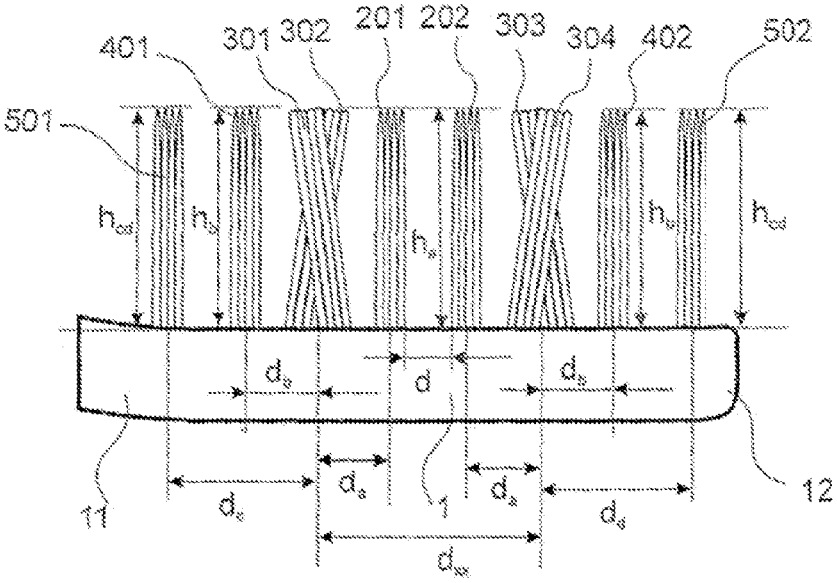
FIG. 2 shows a preferred embodiment of the brush head of the invention.
Figure 3:
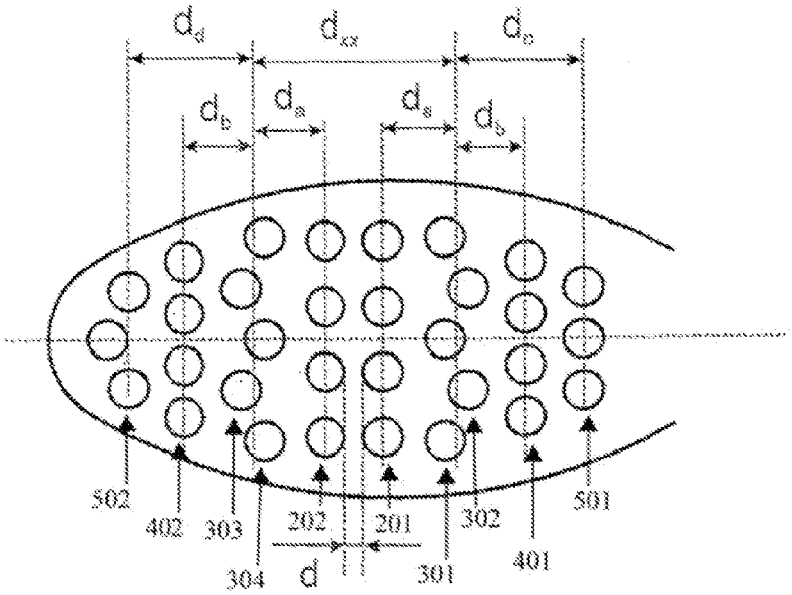
FIG. 3 shows a preferred embodiment of the arrangement of tuft holes on the bristle carrier, which is especially suitable for the brush head per FIG. 2.

Referring to FIGS. 1, 2, and 3, preferred embodiments of the invention shall be described.

FIG. 1 shows, first, the invented brush heads, which need not have the slanted tufts necessarily in the form of an x-wise crossing arrangement; the slanted rows of tufts can also be present slanted only forward or only backward.

A first especially preferred embodiment of the brush head of the invention (FIGS. 2 and 3) has a first and a second transverse row of vertically projecting tufts of pointed bristles. The distance d between them is around 0.8 mm. In the first and second transverse row, the distances of the tufts in the transverse direction is around 2.9 mm and their height $h_a$ is around 11.5 mm. These two transverse rows are bordered by two double rows of slanted, x-wise crossing tufts of cylindrical bristles. The one double row lying nearer to the handle part 11 is formed by a third transverse row of three backward slanted bristle tufts (represented by its frontmost tuft 301) and a fourth transverse row of two forward slanted tufts (represented by its frontmost tuft 302). The other double row closer to the head part 12 is formed by a third transverse row of two backward slanted bristle tufts (represented by its frontmost tuft 303) and a fourth transverse row of three forward slanted tufts (represented by its frontmost tuft 304). The distance $d_x$ between the two transverse rows forming a double row in the lengthwise direction of the brush head is around 1 mm. The height $h_s$ of the slanted tufts contained therein is around 11.5 mm, and the angles $\alpha$ and $\beta$ by which they slant forward and backward are around +8° and around −8° (definitions of $\alpha$ and $\beta$ per FIG. 1). The distance $d_a$ between the double row adjacent to the first transverse row and this first transverse row (or between the double row adjacent to the second transverse row and this second double row) is around 3.2 mm. The distance $d_{xx}$ between the two double rows is around 8.9 mm. Within the third, fourth, fifth and sixth transverse row, which form the two double rows, the distances between the tufts in the transverse direction are around 4.5 mm. At a distance $d_b$ between of around 3.0 mm from the first double row in the lengthwise direction of the brush head toward the handle part 11 is arranged a seventh transverse row of four tufts with pointed bristles vertically upright from the brush body. At a distance $d_b$ in the lengthwise direction of the brush body toward the head part 12 of around 3.0 mm from the second double row is arranged an eighth transverse row of four tufts of pointed bristles vertically upright. In these seventh and eighth transverse row, the distances of the tufts in the transverse direction are around 2.3 mm and the height $h_b$ of the tufts is around 11.5 mm. In the lengthwise direction of the brush head at a distance $d_c$ from the handle part 11 of around 5.5 mm from the first double row is arranged a ninth transverse row of three vertically upright tufts of pointed bristles. In the lengthwise direction of the brush head toward the head part 12 at a distance $d_d$ of around 5.4 mm from the second double row is arranged a tenth transverse row of three vertically upright tufts of pointed bristles, while the middle tuft is staggered forward by around 0.9 mm compared to the two outer tufts (but this is not essential, all three tufts could also lie on a straight line). In the tenth transverse row, the distance between the two outer tufts in the transverse direction is around 4.3 mm; the distance between one of the outer tufts and the middle tuft, slightly staggered to the front, in the transverse direction is around 2.2 mm. If all tufts of the tenth transverse row were to lie precisely on the same line, the distance in the transverse direction between them would be around 2.2 mm. The height $h_{cd}$ of the tufts of the ninth and tenth transverse row is around 11.5 mm. This yields a total complement of 32 tufts (10 x-wise crossing tufts of nonpointed, cylindrical bristles and 22 vertical tufts of pointed bristles, all vertical tufts having the same height). All bristles have a circular cross section over their entire length; the pointed parts of the pointed bristles are thus solids of revolution. The diameter $D_n$ of all cylindrical, nonpointed bristles and the maximum diameter $D_z$ of all pointed bristles is around 0.18 mm. All tufts are of circular cross section; the diameter of all tufts is around 1.7 mm.

FIG. 3 also shows the lengthwise direction of the brush head as a horizontal dotted line.

Similarly to the above described embodiment, other especially preferred embodiments of the invented brush head can be configured as described in the following table 6. In these further embodiments, all numerical parameters which are not specified are as in the previously described first embodiment. The meaning of the variables in the column headings is the same as in the first embodiment described above. The columns "Besatzb" [complement b] and "Besatzcd" [complement cd] indicate the type of bristles in the tufts of the seventh and eighth, or the ninth and tenth transverse row, respectively; "n" means "nonpointed, cylindrical" and "z" means "pointed".

TABLE 6

| Nr. | $h_a$ (mm) | $h_b$ (mm) | $h_{cd}$ (mm) | $Besatz_b$ | $Besatz_{cd}$ | $h_s$ (mm) | $D_n$ (mm) | $D_z$ (mm) |
|---|---|---|---|---|---|---|---|---|
| 2 | 11.5 | 11.5 | 11.5 | z | z | 12.5 | 0.175 | 0.175 |
| 3 | 11.3 | 11.3 | 12.0 | z | n | 12.0 | 0.180 | 0.175 |
| 4 | 11.8 | 11.8 | 11.8 | z | n | 12.5 | 0.175 | 0.175 |
| 5 | 11.3 | 11.5 | 12.0 | n | n | 12.0 | 0.17 | 0.18 |
| 6 | 11.3 | 11.5 | 12.0 | z | z | 11.5 | 0.175 | 0.175 |

Figure 4:
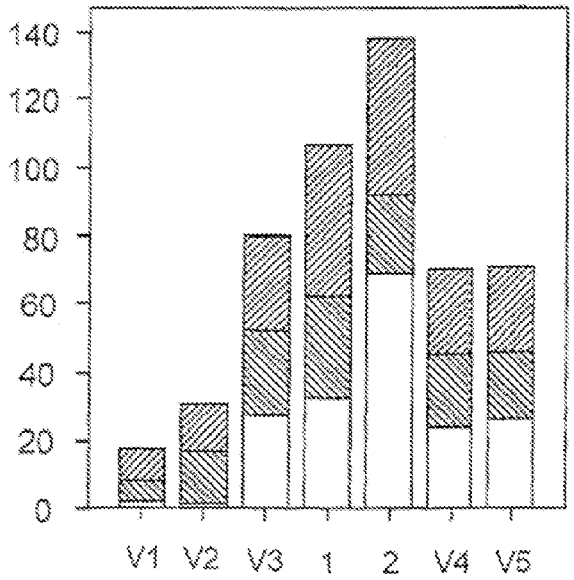
FIG. 4 shows the measured values of the mesial/distal cleaning performance achieved with the brush heads of the invention.

FIG. 4 shows the mesial/distal cleaning performance achieved with embodiments of the invented brush head for horizontal, vertical and circular cleaning motion, as compared to the corresponding cleaning performance of several already known brush heads. In these tests, the teeth of an upper jaw sextant model (with 3 molars, 2 premolars and 1 incisor) were first colored black and then whitewashed over with a titanium dioxide paste (25 g/v in 26% ethanol). After a standardized brushing process with the brush heads being tested for 1 minute duration with 2.45 Newtons pressing force, the percentage of tooth surfaces freed up from the titanium dioxide paste was determined. For the horizontal cleaning, the standardized brushing process consisted of 60 back and forth motions with an amplitude of 30 mm; for the vertical cleaning, it consisted of 60 up and down motions with an amplitude of 8 mm; and for the circular cleaning, it consisted of 60 circles with radius of 4 mm and simultaneous 16 horizontal hack and forth motions with amplitude of 30 mm. Four brush head units were tested on 4 upper jaw sextants each for every brush head type tested and each of the 3 cleaning tests.

FIG. 4 shows the achieved mesial/distal cleaning performance as the total of horizontal, vertical and circular cleaning test in percentage of the tooth surface cleaned. Within each vertical bar, representing a summarized cleaning performance, the share of the rotary test is shown by rising diagonal hatching; the share of the vertical test by descending diagonal hatching; and the share of the horizontal test is without hatching. The brush head types indicated on the x axis of FIG. 4 were according to the following table:

TABLE 7

| | |
|---|---|
| 1 | first embodiment of invention, as described above |
| 2 | $2^{nd}$ embodiment of invention, from table 5 above |
| V1 | comparison brush head similar to FIG. 10 from EP-A-0 855 573; all vertical bristles cylindrical with diameter of 0.203 mm. all slanted bristles cylindrical with diameter of 0.178 mm |
| V2 | like V1, but all bristle diameters 0.178 mm |
| V3 | comparison brush head similar to 1, but all bristles (including those in the slanted tufts) are pointed |
| V4 | comparison brush head similar to EP-A-0 596 633; height of all bristles 11.5 mm |
| V5 | like V4, but height of all bristles 12.5 mm |

It is evident from FIG. 4 that the invented brush heads 1 and 2 are superior to all comparison brush heads in terms of mesial/distal cleaning performance, especially with a rotating horizontal motion of the head.

What is claimed is:

1. A toothbrush comprising:

a handle part;

a head part having a longitudinal axis;

a bristle surface on the head part with tufts of bristles set therein, the tufts of bristles positioned in transverse rows of tufts;

wherein the transverse rows of tufts comprise a first transverse row of tufts comprising bristle tufts that are vertical on the bristle surface, a sixth transverse row of tufts comprising bristle tufts that are slanted forward on the bristle surface, and a third transverse row of tufts comprising bristle tufts that are slanted backward on the bristle surface;

wherein the bristle tufts of the first transverse row of tufts consist of pointed bristles and wherein the bristle tufts of the sixth and third transverse rows of tufts consist of cylindrical bristles;

wherein the first transverse row of tufts is positioned on the head between the sixth and third transverse rows of tufts; and wherein free ends of the bristles of the first, third and sixth transverse rows of tufts collectively form a flat profile.

2. The toothbrush according to claim 1, wherein the transverse rows of tufts further comprise a second transverse row of tufts comprising bristle tufts that are vertical on the bristle surface, the second transverse row of tufts positioned on the head adjacent the first transverse row of tufts and between the sixth and third transverse rows of tufts.

3. The toothbrush according to claim 2 wherein the bristle tufts of the second transverse row of tufts consist of pointed bristles, and at least one tuft of the first transverse row and at least one tuft of the second transverse row are arranged linearly in pairs parallel to a lengthwise direction of the brush head, and are linearly spaced apart at a first distance of 0.65 to 0.95 mm.

4. The toothbrush according to claim 3, wherein the bristle tufts of the first and second transverse TOWS of tufts have a height between 10.0 to 13.0 mm.

5. The toothbrush according to claim 4, wherein the transverse rows of tufts further comprise a fourth transverse row of tufts comprising bristle tufts that are slanted forward on the bristle surface, the bristle tufts of the fourth transverse row of tufts consisting of cylindrical bristles, the third transverse row of backward slanted tufts and the fourth transverse row of forward slanted tufts staggered in a transverse direction such that the bristle tufts of the third and fourth transverse rows of tufts form a double row of x-wise crossing tufts; and wherein the third and fourth transverse rows of tufts are arranged closer to the handle part than are the first and second transverse rows of tufts.

6. The toothbrush according to claim 5, wherein the forward slanted tufts of the fourth transverse row are tilted forward by a first angle of +1° to +45° relative to a line standing vertical to the bristle surface; and wherein the backward slanted tufts of the third transverse row are tilted backward by a second angle of −1° to −45° relative to the line standing vertical to the bristle surface.

7. The toothbrush according to claim 5, wherein the transverse rows of tufts further comprise a fifth transverse row of tufts comprising bristle tufts that are slanted backward on the bristle surface, the bristle tufts of the fifth transverse row of tufts consisting, of cylindrical bristles, the sixth transverse row of forward slanted tufts and the fifth transverse row of backward slanted tufts staggered in the transverse direction such that the bristle tufts of the fifth and sixth transverse rows of tufts form a double row of x-wise crossing tufts; and wherein the fifth and sixth transverse rows of tufts are arranged closer to the head part than are the first and second transverse rows of tufts.

8. The toothbrush according to claim 7, wherein the double row formed from the third and fourth transverse rows of tufts and the double row formed from the fifth and sixth transverse rows of tufts are arranged at a third distance from each other looking in the lengthwise direction of the brush head of between 8.5 to 10.0 mm.

9. The toothbrush according to claim 7, wherein the transverse rows of tufts further comprise a seventh transverse row of tufts vertically projecting from the bristle surface, which is arranged at a fourth distance from the double row formed of the third and fourth transverse rows toward the handle part looking in the lengthwise direction of the brush head, and an eighth transverse row of tufts vertically projecting from the bristle surface, which is arranged at the fourth distance from the double row formed of the fifth and sixth transverse rows lying toward the head part looking in the lengthwise direction of the bristle surface, wherein the fourth distance is between 2.5 to 15 mm.

10. The toothbrush according to claim 9, wherein the bristle tufts of the seventh and eighth transverse rows consist of pointed bristles having a height that is equal to the height of the bristle tufts of the first and second transverse rows.

11. The toothbrush according to claim 9, wherein the transverse rows of tufts further comprise a ninth transverse row of tufts vertically projecting from the bristle surface, which is arranged at a fifth distance from said double row of third and fourth transverse rows toward the handle part, looking in the lengthwise direction of the brush head, and a tenth transverse row of pointed tufts vertically projecting from the bristle surface, which is arranged at a sixth distance from said double row of fifth and sixth transverse rows lying toward the head part in the lengthwise direction of the bristle surface, and the fifth distance between the ninth transverse row of tufts and the third and fourth transverse rows of tufts is between 5.0 to 6.0 mm.

12. The toothbrush according to claim 11, wherein the tufts of the ninth and tenth transverse rows consist of pointed bristles having a height of between 10.0 to 13.0 mm.

13. The toothbrush according to claim 1 wherein the pointed bristles consist of polyethylene terephthalate, polypropylene terephthalate, polybutylene terephthalate or polypentylene terephthalate; and the cylindrical bristles consist of polydimethylene adipamide, polytrimethylene adipamide, polytetramethylene adipamide, polypentamethylene adipamide, polyhexamethylene adipamide, polydimethylene dodecanamide, polytrimethylene dodecanamide, polytetramethylene dodecanamide, polypentamethylene dodecanamide, or polyhexamethylene dodecanamide.

14. A toothbrush comprising:

a handle part;

a head part having a longitudinal axis;

a bristle surface on the head part with tufts of bristles set therein, the tufts of bristles positioned in transverse rows of tufts;

wherein the transverse rows of tufts comprises a first transverse row of tufts comprising bristle tufts that are vertical on the bristle surface, a fourth and a sixth transverse row of tufts comprising bristle tufts that are slanted forward on the bristle surface, and a third and a fifth transverse row of tufts comprising bristle tufts that are slanted backward on the bristle surface;

wherein the bristle tufts of the first transverse row of tufts consist of pointed bristles and wherein the bristle tufts of the third, fourth, fifth and sixth transverse rows of tufts consist of cylindrical bristles;

wherein the bristle tufts of the third and fourth transverse rows of tufts form a first double row of x-wise crossing tufts, and wherein the bristle tufts of the fifth and sixth transverse rows of tufts form a second double row of x-wise crossing tufts;

wherein the first transverse row of bristle tufts is positioned on the bristle surface between the first and second double rows of x-wise crossing tufts; and wherein free ends of the bristles of the first, third, fourth, fifth and sixth transverse rows of tufts collectively form a flat profile.

15. The toothbrush of claim 14 wherein the bristle tufts of the fourth and sixth transverse rows of tufts are tilted forward by a first angle between +1° to +45° relative to a line standing vertical to the bristle surface; and wherein the bristle tufts of the fifth and sixth rows of tufts are tilted backward by a second angle between −1° to −45° relative to the line standing vertical to the bristle surface.

16. The toothbrush of claim 14 wherein the first double row of x-wise crossing tufts is positioned on the bristle surface closer to the handle part than the first transverse row of tufts and wherein the second double row of x-wise crossing tufts is positioned on the bristle surface closer to the head part than the first transverse row of tufts.

17. The toothbrush according to claim 14 wherein the third transverse row of tufts consists of three backward slanted bristle tufts, the fourth transverse row of tufts consists of two forward slanted bristle tufts, the fifth transverse row of tufts consists of two backward slanted bristle tufts and the sixth transverse row of tufts consists of three forward slanted bristle tufts.

* * * * *